US007188800B2

(12) United States Patent
Bessems et al.

(10) Patent No.: US 7,188,800 B2
(45) Date of Patent: Mar. 13, 2007

(54) COLLAPSIBLE WINDING CORE AND METHOD OF MAKING SAME

(75) Inventors: Nico J. C. Bessems, Maastricht (NL); Emile Henricus Lutgens, Maastricht (NL); Ed Spronk, Margraten (NL); Johannes W. van de Camp, Hartsville, SC (US); John Whitehead, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 270 days.

(21) Appl. No.: 10/924,355

(22) Filed: Aug. 23, 2004

(65) Prior Publication Data

US 2006/0151663 A1 Jul. 13, 2006

(51) Int. Cl.
*B65H 75/08* (2006.01)

(52) U.S. Cl. ..... 242/613; 242/610; 242/610.1

(58) Field of Classification Search ..... 242/613, 242/610, 610.1, 610.4, 610.6, 613.4–613.5, 242/118.3, 118.32; 493/269, 276
See application file for complete search history.

(56) References Cited

U.S. PATENT DOCUMENTS

| | | | | |
|---|---|---|---|---|
| 252,400 | A | 1/1882 | Pierce | |
| 347,416 | A | 8/1886 | Buckingham | |
| 685,780 | A | 11/1901 | Martin | |
| 1,683,707 | A | 9/1928 | Smith | |
| 3,279,333 | A * | 10/1966 | Blair et al. | 493/274 |
| 3,280,708 | A * | 10/1966 | Jensen | 493/343 |
| 3,455,521 | A | 7/1969 | Cunningham et al. | |
| 3,545,494 | A * | 12/1970 | Cunningham | 138/144 |
| 3,555,976 | A * | 1/1971 | Carter et al. | 493/274 |
| 5,255,865 | A | 10/1993 | Buell et al. | |
| 5,318,235 | A | 6/1994 | Sato | |
| 5,425,693 | A * | 6/1995 | Gardner et al. | 493/301 |
| 6,190,485 | B1 * | 2/2001 | Cahill et al. | 156/195 |
| 6,391,135 | B1 * | 5/2002 | Drummond et al. | 156/192 |
| 6,815,022 | B2 * | 11/2004 | Renck et al. | 428/34.3 |

* cited by examiner

*Primary Examiner*—William A. Rivera
*Assistant Examiner*—Sang Kim
(74) *Attorney, Agent, or Firm*—Alston & Bird LLP

(57) ABSTRACT

A winding core capable of being made in relatively thick-walled configurations and yet capable of being readily collapsed into a flattened configuration for shipping or storage prior to use comprises a plurality of fibrous plies helically wound one atop another and adhered together to form a tube. The plies are arranged in two or more groups of two or more plies each. The plies of each group are adhered to one another over at least a substantial majority of their facing surfaces, but the adjacent groups are non-adhered to each other over at least a substantial majority of their facing surfaces.

9 Claims, 2 Drawing Sheets

COLLAPSIBLE WINDING CORE AND METHOD OF MAKING SAME

BACKGROUND OF THE INVENTION

The invention relates to winding cores or winding cores, and relates in particular to cores or tubes for rolls of sheet metal.

Sheet metal such as steel, aluminum, and the like, is typically provided in bulk in the form of large rolls wound about cores. When winding rolls of heavier gauge metal, the stiffness of the wound sheet is usually high enough to withstand the weight of the roll, such that it is not essential to use a winding core, and quite often the metal industry uses "coreless" winding. However, when the metal sheet has been coated or oiled such that it is slippery, winding cores are usually necessary in order to be able to wind the rolls with sufficient tension from the very beginning of the winding process to compensate for the low coefficient of friction of the wound sheet. Only by winding with high tension can a self-supporting roll with good roll stability be achieved, and such high tension requires the use of a winding core. The winding core is typically a wound paperboard construction. The core is usually sleeved over a winding mandrel that is radially expandable to grip the core so that the core does not slip relative to the mandrel.

Additionally, winding cores are beneficial to prevent damage to the innermost layers of the sheet metal from forklift forks or lifting chains that are inserted into the rolls for moving them about. In an increasingly competitive and cost-conscious environment, end users want to be able to use the full length of the wound metal sheet, so that damage to the inner layers cannot be tolerated. Accordingly, winding cores are desirable even when not essential for good roll stability.

Because the core is only required for protection, customers want the core to be as inexpensive as possible. These fiber cores usually have a diameter of 16 inches, but other sizes are also commonly used. Shipping and storage of such large cores is very expensive and transport can be as much as 30 percent of total costs.

BRIEF SUMMARY OF THE INVENTION

The invention addresses the above needs and achieves other advantages, by providing a winding core capable of being made in relatively thick-walled configurations and yet capable of being readily collapsed into a flattened configuration for shipping or storage prior to use. In accordance with one aspect of the invention, a plurality of fibrous plies are helically wound one atop another and adhered together to form a tube, but the adhesive is not applied to the entire surfaces of all plies. Instead, the tube is formed as a plurality of separate shells, as a shell-within-a-shell construction. Each shell comprises two or more plies that are adhered to each other over all of their surfaces or at least over a substantial majority of their surfaces, but adjacent shells are substantially non-adhered to each other. For example, in the simplest embodiment, a tube comprises two shells each comprising two plies, such that there are four plies in total, which can be labeled as plies 1, 2, 3, and 4, from inside to outside. Plies 1 and 2 are adhered to each other, and plies 3 and 4 are adhered to each other, but plies 2 and 3 are substantially non-adhered to each other. This structure is designated a "2/2" structure, meaning an inner shell of two plies is within an outer shell of two plies.

In another embodiment, the winding core has 7 plies in a 2/2/3 structure. An 8-ply winding core is also possible, having a 2/2/2/2 structure, or alternatively having a 2/3/3 or a 4/4 structure.

A 9-ply winding core in accordance with another embodiment has a 3/3/3 structure. Alternatively, the 9-ply tube can have a 2/2/2/3 structure. A 10-ply winding core can have a 2/2/2/2/2 structure. Alternatively, the 10-ply tube can have a 2/2/3/3 structure, a 3/3/4 structure, a 2/4/4 structure, or others.

It is at least theoretically possible for a winding core formed as a shell-within-a-shell structure to "telescope" under load, such that the shells shift axially relative to each other along their non-adhered interfaces. To prevent this from happening, winding cores in accordance with the invention advantageously include adhesive applied in a partial-coverage pattern between adjacent shells. In preferred embodiments, the partial-coverage pattern comprises at least one axially extending band of adhesive, and more preferably two axially extending bands of adhesive at diametrically opposite positions of the tube, to adhere each shell to its adjacent shell(s).

Thus, winding cores in accordance with preferred embodiments of the invention have two or more shells each comprising two or more plies, wherein the plies of each shell have adhesive applied over a relatively large proportion of their surfaces or over their entire surfaces, and adjacent shells have adhesive applied over a relatively small proportion of their surfaces (preferably in two diametrically opposite bands that extend axially along the tube).

The invention also encompasses methods of making winding cores. In accordance with the invention, a method for making a winding core comprises the steps of advancing a plurality of fibrous plies from respective supply rolls toward a cylindrical mandrel and helically wrapping the plies one atop another about the mandrel at a helical winding angle relative to a longitudinal axis of the mandrel so as to form a tubular structure, and providing regions of adhesive along facing surfaces of the plies. The plies are adhered to each other in groups of two or more, each group forming a shell. The plies of each shell are adhered together over a relatively large proportion of their surfaces or over their entire surfaces. Adjacent shells are either not adhered together at all, or are adhered together over a relatively small proportion of their surfaces to prevent telescoping of the tube as previously noted.

In certain preferred embodiments, between adjacent shells the adhesive is applied as discrete regions (e.g., stripes) of adhesive spaced apart in a lengthwise direction of the plies and angled at substantially the helical winding angle relative to the lengthwise direction of the plies. Accordingly, when the plies are wrapped about the mandrel, the regions of adhesive extend axially along the tube.

In a preferred embodiment, the regions of adhesive are spaced apart along the plies by a distance substantially equal to half of a circumference of the tube, whereby the adjacent shells are adhered to one another at two diametrically opposite, axially extending bands defined by the regions of adhesive. In one embodiment, the regions of adhesive are applied at an adhesive application station located between the supply rolls and the mandrel. The adhesive application station can comprise a gravure roll, or the like, for printing a region of adhesive on the ply at regular spaced intervals as the ply is advanced to the mandrel.

The term "adhesive" as used herein is broadly directed to any substance capable of affixing the plies to one another, and includes aqueous adhesives, solvent-based adhesives, cold seal or cohesive materials, and others. When cohesive is employed, it must be disposed on both facing surfaces of two adjacent plies since cohesive sticks only to itself, but with other types of adhesives it is sufficient for the adhesive to be present on only one of the facing surfaces to be joined.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
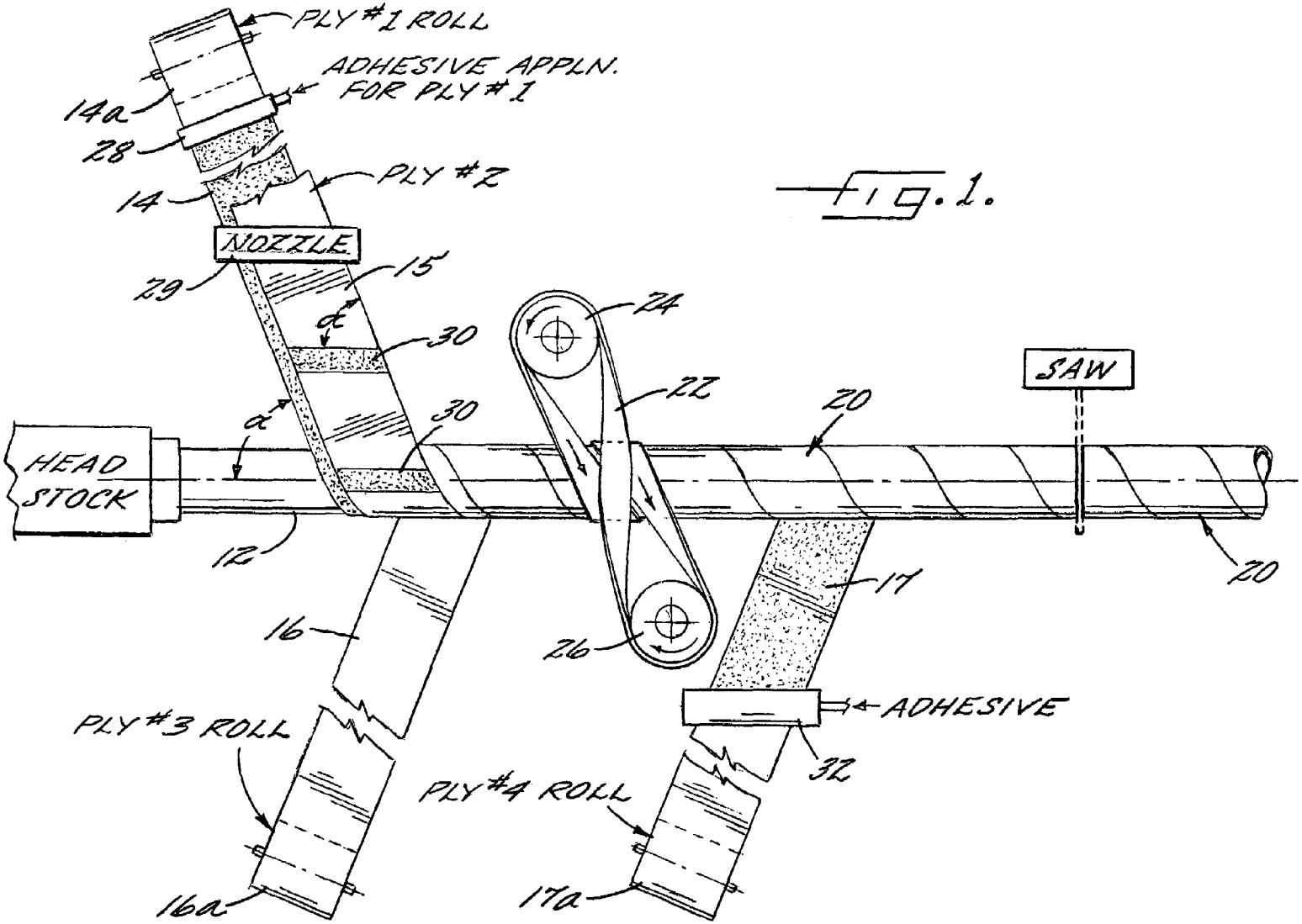
FIG. 1 is a diagrammatic illustration of an apparatus and process for making a collapsible winding core in accordance with one embodiment of the invention.
Figure 2:
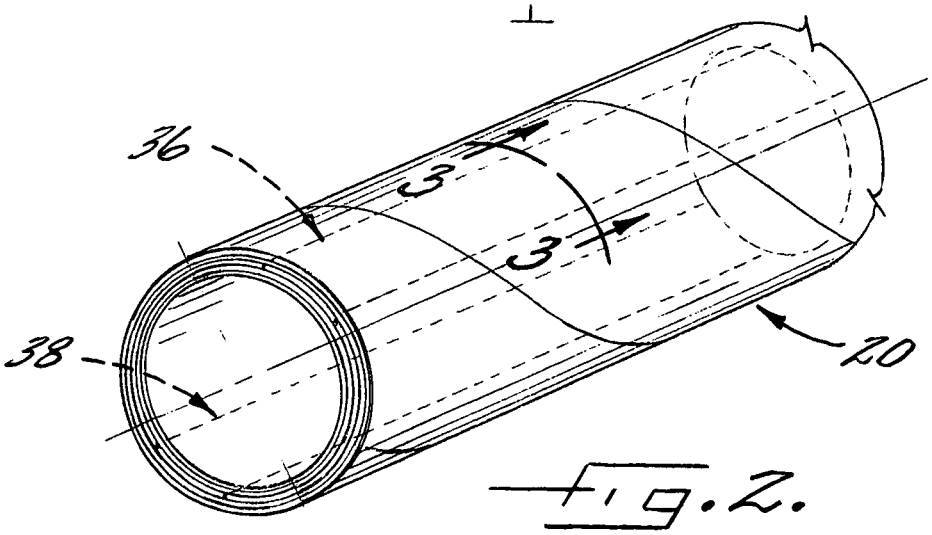
FIG. 2 is a perspective view of a winding core made in accordance with the process of FIG. 1.

An apparatus and process for making a collapsible winding core in accordance with one embodiment of the invention is depicted in FIG. 1. The apparatus includes a cylindrical mandrel 12 whose outside diameter is selected to match the desired inside diameter of the winding core to be constructed. Winding cores in accordance with the invention may have inside diameters up to about 20 inches or more. The mandrel 12 is formed of a suitable metal such as steel, with a highly smooth surface to allow fibrous plies to slip freely along the mandrel. A winding core is constructed by helically winding two or more plies of fibrous material such as paperboard about the mandrel 12 in radially layered relationship and adhering the plies together with a suitable adhesive material applied to the plies in selected regions.

More particularly, in the embodiment of FIG. 1, four plies 14, 15, 16, 17 are helically wound about the mandrel 12. However, winding cores in accordance with the invention may have as many as 15 or more plies. Each of the plies is wound at a wind angle $\alpha$ measured between the lengthwise direction of the ply and the longitudinal axis of the mandrel 12. The wind angle $\alpha$ can vary depending on the diameter of the mandrel and the width of the ply. If the ply forms a perfect butt joint between opposite edges of the ply, then the wind angle $\alpha$, diameter D, and ply width W are related by the equation $$W=\pi D \cos \alpha.$$

Ideally, each ply would be wound with a perfect butt joint, but in practice it is common for one or more plies to be wound with a slight overlap or a slight gap (generally ¼-inch or less) between the edges of sequential turns of the ply.

The adhesion of the plies to one another is discussed in detail below. Once the plies are adhered to one another, they form a tube 20 on the mandrel. The tube 20 has substantial integrity, although generally the tube does not possess full strength until the adhesive has fully dried. However, the tube has sufficient integrity to hold together under the stresses imposed on it during the tube formation process. The tube 20 is advanced helically or in screw fashion along the mandrel 12 by a winding belt 22, which is driven at the desired wind angle $\alpha$ by a pair of rotating drums 24, 26 as known in the art. The screw-type movement of the tube 20 is what supplies the motive force for drawing the plies from their respective supply rolls (e.g., supply rolls 14*a*, 16*a*, 17*a* are shown for plies 14, 16, 17), advancing the plies to the mandrel, and wrapping the plies about the mandrel.

In the embodiment of FIG. 1, the innermost ply 14 and the outermost ply 17 are each advanced past an adhesive application station at which adhesive is applied to selected regions of each ply for adhering all of the plies to one another. Thus, the innermost ply 14 is advanced from its supply roll 14*a* to an adhesive applicator 28 located between the supply roll and the mandrel 12. The adhesive applicator 28 is operable to apply adhesive to the ply 14 over its entire outward-facing surface (i.e., the surface that faces away from the mandrel 12), and can comprise a roller or other suitable device. The next ply 15 is wound atop the first ply 14 and is adhered to the first ply by virtue of the adhesive applied to the outward-facing surface of the ply 14. The plies 14, 15 form an inner group or shell on the mandrel.

In accordance with the invention, the third ply 16 is non-adhered to the underlying ply 15 over at least the majority of the facing surfaces of the plies, and can be non-adhered over the entire surfaces in some cases. However, to prevent possible telescoping or axial displacement between the plies 15, 16, these plies can be adhered at discrete regions such as at one or more axially extending bands. In the embodiment of FIG. 1, the plies 15, 16 are adhered at two diametrically opposed bands. Accordingly, an adhesive applicator 29 is operable to apply adhesive regions 30 to the outward-facing surface of the ply 15 so that the regions are spaced apart by half of the mandrel circumference. The adhesive regions 30 are shown as stripes of continuous coverage along their length, although discontinuous patterns can also be used. The stripes are angled with respect to the lengthwise direction of the ply 14, at the same angle as the helical wind angle $\alpha$; accordingly, when the ply 14 is wound about the mandrel 12, the stripes 30 are oriented parallel to the longitudinal axis of the mandrel. Various types of adhesive applicators 29 can be used, including but not limited to a gravure roll, or a slot nozzle applicator that operates intermittently to apply the adhesive in spaced regions along the ply.

The ply 17 is advanced past an adhesive applicator 32 comprising a roller or other suitable device for applying adhesive to the entire surface of the ply that faces the underlying ply 16; alternatively, the adhesive could cover less than the entire surface, but preferably covers a substantial majority of the surface. The last ply 17 is shown being wound onto the mandrel downstream of the belt 22, but alternatively could be wound upstream of the belt.

The simple embodiment illustrated in FIG. 1 provides a winding core formed of two shells: an inner shell formed by plies 14, 15, and an outer shell formed by plies 16, 17. The two plies of each shell are adhered to each other over all or at least over a substantial majority of their facing surfaces. The two shells, however, are generally non-adhered to each other except at two diametrically opposite adhesive bands 36, 38 formed by the adhesive regions 30.

Figure 3:
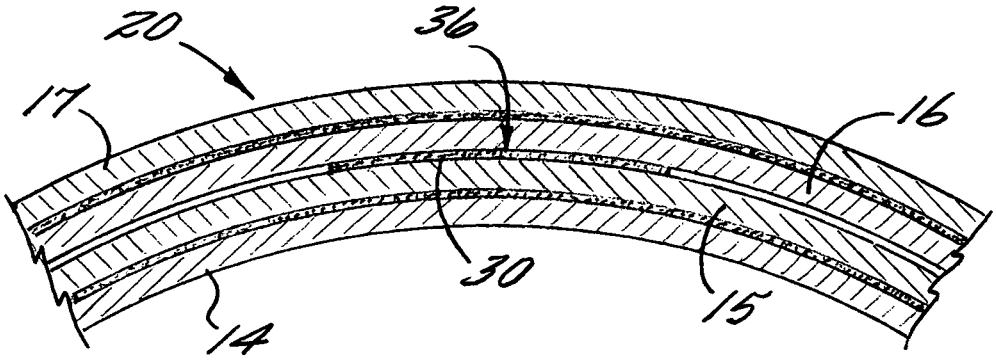
FIG. 3 is a cross-sectional view of the winding core along line 3—3 in FIG. 2.

The invention is not limited to having two adhesive bands between adjacent shells or groups of plies. In alternative embodiments, a winding core in accordance with the invention can have only one adhesive band 36 (FIG. 3) extending axially along the tube, or can have more than two bands. It is apparent based on the foregoing description of the adhesive applicators and their operation how any desired number of adhesive bands can be provided by suitably configuring and operating the adhesive applicators.

Each of the adhesive bands 36, 38 has a circumferential extent that is substantially less than half of the tube circumference. Preferably, each band occupies less than about 25 percent of the circumference, more preferably less than about 10 percent of the circumference, and still more preferably less than about five percent of the circumference. For example, a winding core having a diameter of about 16 inches can have two adhesive bands each about 2 inches wide.

As noted, the invention is not limited to any particular number of plies or any particular number of shells. To make a winding core that is readily foldable into a flattened configuration, however, the practical maximum limit for wall thickness is expected to be about 2% of the diameter; a suitable number of plies should be used so that this limit is not exceeded. More preferably, the wall thickness should not exceed about 1.5% of diameter.

Figure 4:
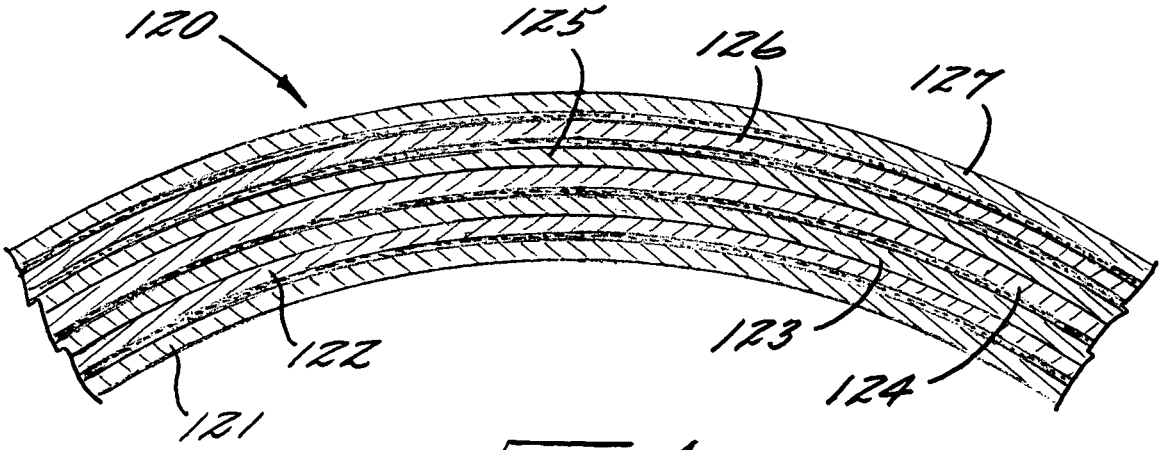
FIG. 4 is a cross-sectional view of a 7-ply winding core in accordance with another embodiment of the invention.

FIG. 4 shows a winding core 120 in accordance with another embodiment of the invention. The core has seven plies arranged in three groups, as a 2/2/3 structure. Thus, an inner shell is formed by two plies 121, 122 that are joined by adhesive over all or at least a substantial majority of their facing surfaces. A middle shell is formed by two additional plies 123, 124 that are joined to each other by adhesive over all or at least a substantial majority of their facing surfaces. Ply 123 is not joined to ply 122, or these plies are non-adhered over at least a substantial majority of their facing surfaces, for example by having axial bands of adhesive as previously described, but otherwise being non-adhered to each other. An outer shell is formed by three final plies 125, 126, 127, which are joined to one another by adhesive over all or at least a substantial majority of their facing surfaces. Ply 125 is not joined to ply 124, or these plies are non-adhered over at least a substantial majority of their facing surfaces, for example by having axial bands of adhesive as previously described, but otherwise being non-adhered to each other.

Numerous other winding core structures can be made in accordance with the invention. An 8-ply winding core can have a 2/2/2/2 structure, or alternatively a 2/3/3 or a 4/4 structure. A 9-ply winding core in accordance with another embodiment can have a 3/3/3 structure. Alternatively, the 9-ply tube can have a 2/2/2/3 structure. A 10-ply winding core can have a 2/2/2/2/2 structure. Alternatively, the 10-ply tube can have a 2/2/3/3 structure, a 3/3/4 structure, a 2/4/4 structure, or others. Cores with more than 10 plies are also possible.

A test was conducted to determine the effect of partial adhesion of the plies in accordance with the invention on certain strength properties of a winding core. Two types of cores were constructed, each comprising nine plies of paperboard of 0.020 inch thickness and a tenth outermost ply of 0.013 inch thickness. The resulting wall thickness of the finished and conditioned cores was about 0.183 inch. The winding cores had an inside diameter of 16.040 inches. A control core for comparison purposes had all of the plies fully adhered to one another, as in conventional cores. A core in accordance with the invention was identical to the control core except that it was formed as a 5-shell structure with each shell comprising two plies, i.e., a 2/2/2/2/2 structure. Thus, where ply #1 is the innermost ply and ply #10 is the outermost, plies 1 and 2 were fully adhered but there was no adhesive between plies 2 and 3; plies 3 and 4 were fully adhered but there was no adhesive between plies 4 and 5; etc.

The cores were tested for burst strength by placing an inflatable membrane within the cores and pressurizing the membrane until the cores failed. The control core failed at a pressure of 180 psi, and the failure mode was a fracture extending radially through all of the plies. The partially adhered core in accordance with the invention failed at a pressure of 165 psi, and the failure occurred only in the outermost ply #10, which failed along the spiral joint of the underlying ply #9. At any rate, there was a loss of approximately 10% in burst strength for the partially adhered core compared to the fully adhered core.

The cores were also tested for supported $E_c$, or outside diameter stiffness. The outside diameter stiffness is a measure of how much hydrostatic pressure can be exerted on the outer surface of the core to cause a given reduction in the outside diameter of the core, and is expressible in units of psi/inch, for example. The supported $E_c$ is determined while the core is supported on a mandrel. The control core was tested to have a supported $E_c$ of about 37,400 psi/inch. The partially adhered core was tested to have a supported $E_c$ of about 35,600 psi/inch, which is a loss of approximately 5% from the control core.

Thus, the test results suggest that winding cores in accordance with the invention lose a relatively small proportion of the burst strength and outside diameter stiffness of fully adhered cores, even though the reduction in adhesive can approach 50 percent. The above-described test results were obtained for a partially adhered core wherein no adhesive was used between adjacent shells. It is expected the strength reduction may be even less for a core wherein the above-described axial bands of adhesive are present between adjacent shells.

Another strength aspect of the winding core that was investigated is the loss of tensile strength caused by folding the core into a flattened configuration. It is expected that a sharp fold in the core wall will lead to some amount of fiber breakage and thus result in a reduction in tensile strength. To test this hypothesis, several sets of partially adhered cores were constructed. One set of cores had a 2/2/2/2 structure, another had a 3/3 structure, and a third had a 4/4 structure. The cores were folded flat, and then three samples were cut from the unfolded region of each core and three samples were cut from the folded region of each core. The samples were tested for tensile strength in an tensile test machine and the three test results were averaged for the unfolded and folded samples. For the 2/2/2/2 core, the unfolded samples had an average tensile strength of about 9280 psi, while for the folded samples the average tensile strength was about 7160 psi (approximately 23% reduction). For the 3/3 core, the unfolded sample average tensile strength was about 9370 psi, and for the folded samples it was about 7700 psi (approximately 18% reduction). For the 4/4 core, the unfolded sample average tensile strength was about 9610 psi, and for the folded samples it was about 5630 (approximately 41% reduction). These results suggest that shells having four or more plies should be avoided; it is preferable to employ shells of two or three plies each.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A winding core that is collapsible into a flattened configuration, comprising:

a plurality of fibrous plies wrapped helically about an axis one atop another to form a tubular structure, the plies being arranged in at least two groups of at least two plies each, the plies of each group being adhered to one another over at least a substantial majority of facing surfaces of the plies, and adjacent groups being non-adhered to each other over at least a substantial majority of facing surfaces of the groups.

2. The winding core of claim 1, wherein the adjacent groups of plies are adhered to each other with one or more axially extending bands of adhesive applied between the facing surfaces of the groups.

3. The winding core of claim 2, wherein the one or more bands of adhesive are two in number and are circumferentially spaced about 180 degrees apart.

4. The winding core of claim 1, wherein the plies of each group are adhered together over the entire facing surfaces of the plies.

5. The winding core of claim 1, wherein the plies comprise paperboard.

6. The winding core of claim 1, wherein the core comprises at least 7 plies.

7. The winding core of claim 1, wherein each group has a maximum of 3 plies.

8. The winding core of claim 7, wherein there is a maximum of 5 groups of plies.

9. A winding core that is collapsible into a flattened configuration, comprising:

a plurality of fibrous plies wrapped helically about an axis one atop another to form a tubular structure, the plies being arranged in at least two groups of at least two plies each, the plies of each group being adhered to one another over substantially all of facing surfaces of the plies, and adjacent groups being adhered to each other only along one or more axially extending regions collectively occupying a minority of facing surfaces of the adjacent groups.

* * * * *